US008801479B1

(12) United States Patent
Quail

(10) Patent No.: US 8,801,479 B1
(45) Date of Patent: Aug. 12, 2014

(54) HYDRAULIC MARINE JACK PLATE POSITION INDICATOR SYSTEM

(76) Inventor: Richard W. Quail, Pinellas Park, FL (US)

( * ) Notice: Subject to any disclaimer, the term of this patent is extended or adjusted under 35 U.S.C. 154(b) by 0 days.

(21) Appl. No.: 13/457,367

(22) Filed: Apr. 26, 2012

(51) Int. Cl.
*B63H 5/125* (2006.01)

(52) U.S. Cl.
USPC ..... 440/53; 440/61 R

(58) Field of Classification Search
USPC ..... 440/53, 55, 61
See application file for complete search history.

(56) References Cited

U.S. PATENT DOCUMENTS 3,591,825 A * 7/1971 Keighley, Jr. ..... 315/82
4,354,214 A * 10/1982 Walton ..... 361/23
4,359,681 A * 11/1982 Baker et al. ..... 323/320
4,482,330 A * 11/1984 Cook ..... 440/2
4,549,105 A * 10/1985 Yamamoto et al. ..... 310/87
4,652,878 A * 3/1987 Borgersen ..... 340/984
5,749,696 A * 5/1998 Johnson ..... 414/635
5,782,662 A * 7/1998 Icenogle ..... 440/61 R
6,126,498 A * 10/2000 Icenogle et al. ..... 440/53
7,285,014 B2 * 10/2007 Castaldo et al. ..... 439/589
7,311,569 B2 * 12/2007 Mullen et al. ..... 440/55
7,416,459 B1 * 8/2008 Pelini ..... 440/61 R
7,527,539 B1 * 5/2009 Pelini ..... 440/61 R
7,731,552 B1 * 6/2010 Pelini ..... 440/53
8,210,886 B1 * 7/2012 Pelini ..... 440/53
2008/0144341 A1 * 6/2008 Cook ..... 363/53

* cited by examiner

*Primary Examiner* — Lars A Olson
*Assistant Examiner* — Jovon Hayes

(57) ABSTRACT

A position indicator for tracking the position of the slide in relation to the support. The position indicator comprises an electronic signal generator device formed as a transducer which is capable of being activated, and an electronic signal generating device formed as a magnet. One of the transducer and the magnet is attached to the hydraulic cylinder. The electronic device is positioned near said activator wherein the signal output of the electronic device is regulated, in relation to ambient light, by a photoelectric cell.

1 Claim, 5 Drawing Sheets

HYDRAULIC MARINE JACK PLATE POSITION INDICATOR SYSTEM

BACKGROUND OF THE INVENTION

Related Applications

The present application is an improvement over my prior U.S. patent application Ser. No. 09/329,375 filed Jun. 10, 1999, and issued Oct. 3, 2000 as U.S. Pat. No. 6,126,498, the subject matter of which is incorporated herein by reference.

FIELD OF THE INVENTION

This invention is concerned with hydraulic marine jack plates which are commonly used in conjunction with outboard motors. Most larger outboard motors are supplied with integral hydraulic motors and related hydraulic cylinders wherein the outboard motor can be angularly disposed in relation to the transom of a boat to which it is attached. While this angular disposition of an outboard motor in relation to the transom of a boat is useful, in many situations it has been found that it is highly desirable to move an outboard motor vertically in a plane which is parallel with the transom of a boat. It is in this field that hydraulic jack plates of this invention is useful.

When a hydraulic jack plate is used to move an outboard motor vertically up the efficiency of the outboard motor can be greatly enhanced particularly in high speed operation. In many instances when an outboard motor and the boat to which it is attached is operating at high speeds the lower unit of the outboard motor creates excessive drag which impairs the operating efficiency of the outboard motor and the boat to which it is attached.

By the use of a hydraulic jack plate an outboard motor can be moved in a vertical plane in order that the outboard motor and boat combination can achieve optimum operating efficiency under all operating conditions.

Further by use of a hydraulic jack plate an outboard motor can be moved up in order to allow the outboard motor and boat combination to operate in shallow water. In many instances by using a hydraulic jack plate and moving the outboard motor up most boats can operate in water which is only a few inches deeper than the draft of the particular boat.

The subject invention is concerned with an improvement wherein the position of a marine hydraulic jack plate can be remotely determined.

This enhancement is achieved by providing apparatus whereby the position the slide of a hydraulic jack plate, and hence the position of the outboard motor which is attached thereto can be determined in relation to a fixed point usually the top of the transom of the boat.

Accordingly, it is an object of this invention to provide a hydraulic jack plate position indicator wherein the sensor and indicator are remote to each other.

It is a further object of this invention to provide a hydraulic jack plate sensor system which is light sensitive.

These objects and advantages should be construed as merely illustrative of some of the more prominent features and applications of the present invention. Accordingly, other objects and advantages, as well as a fuller understanding of the invention, may be had by referring to the summary and detailed description of the preferred embodiment of the invention in addition to the scope of the invention, taken in conjunction with the accompanying drawings accompanying drawings.

SUMMARY OF THE INVENTION

The present invention is defined by the specific preferred and alternate embodiments shown in the attached drawings. For the purpose of summarizing the invention, the invention may be defined as a hydraulic jack plate position indicator wherein the position of a hydraulic jack plate is segmented and each segment incorporates with a particular light emitting dioide herein after referred to as L.E.D.

Hydraulic jack plates comprise four main components these being a hydraulic pump, a hydraulic cylinder, a support which is attached to the transom of a boat and a slide which moves in the support and to which the outboard motor is attached. This invention is concerned with apparatus whereby the position of the slide and hence the position of the outboard motor can be determined.

In order to achieve these ends the support is provided with an activator and the slide is provided with a segmented transducer. Each segment of the transducer produces a specific voltage which activates a particular voltage sensitive L.E.D. in a gauge assembly. The gauge assembly comprises a plurality of voltage sensitive L.E.D.'s. The hydraulic jack plate indicator system of this invention is further provided with a means whereby the intensity of the light emitted by the L.E.D.'s can be regulated in relation to the ambient light in which the gauge assembly is located.

The foregoing has outlined rather broadly the more pertinent and important features of the present invention in order that the detailed description of the invention that follows may be better understood. Additional features of the invention will be described hereinafter which form the subject of the claims of the present invention. It is appreciated by one skilled in the art, that the conception and the specific embodiment disclosed herein may be readily utilized as a basis for modifying or designing other apparatus or processes for carrying out the purposes of the present invention. It is also realized by one skilled in the art that such equivalent apparatus and process do not depart from the spirit and scope of the invention as set forth herein.

DESCRIPTIONS OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures including the primary and alternate embodiment of the invention.

DESCRIPTION OF THE PREFERRED EMBODIMENT

Figure 3:
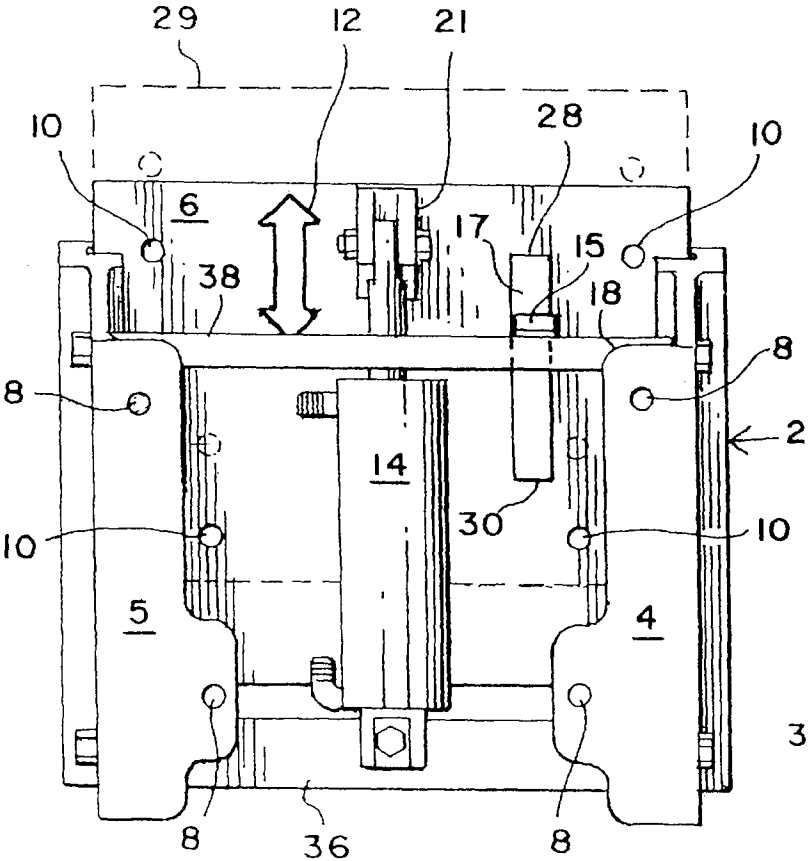
FIG. 3 is a rear view showing a hydraulic jack plate with the position indicator of this invention attached thereto.

As is generally discussed above the subject invention relates to a position indicator for use with a marine hydraulic jack plate as is shown in FIG. 3, the movement of slide 6 of jack plate 2 is illustrated by phantom line 29.

Figure 1:
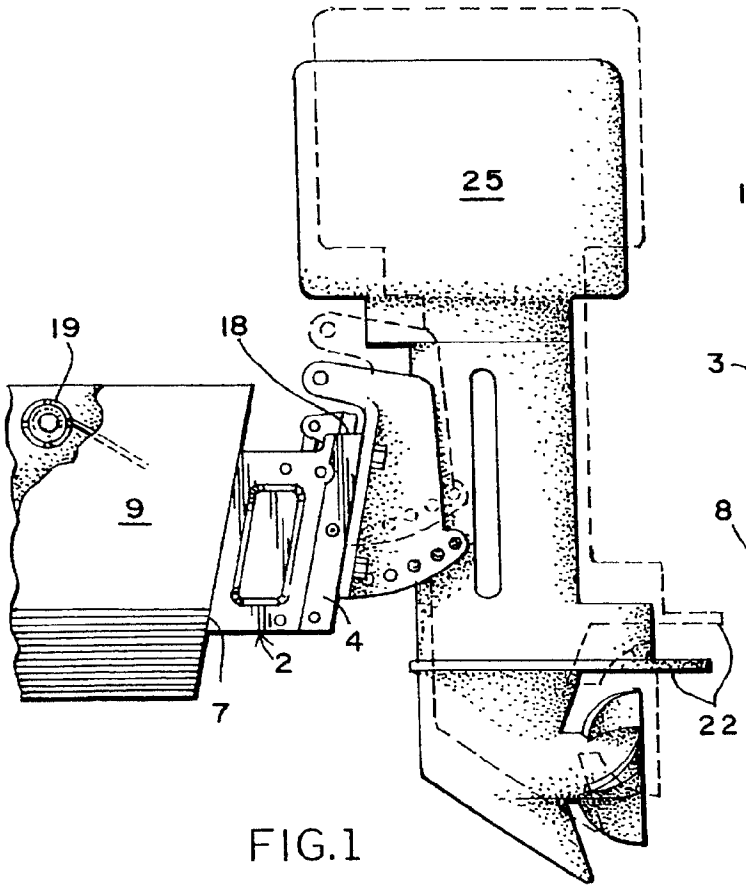
FIG. 1 is a side view showing the general relationship of a hydraulic jack plate, a boat and an outboard motor which are the subject matter of this invention.
Figure 4:
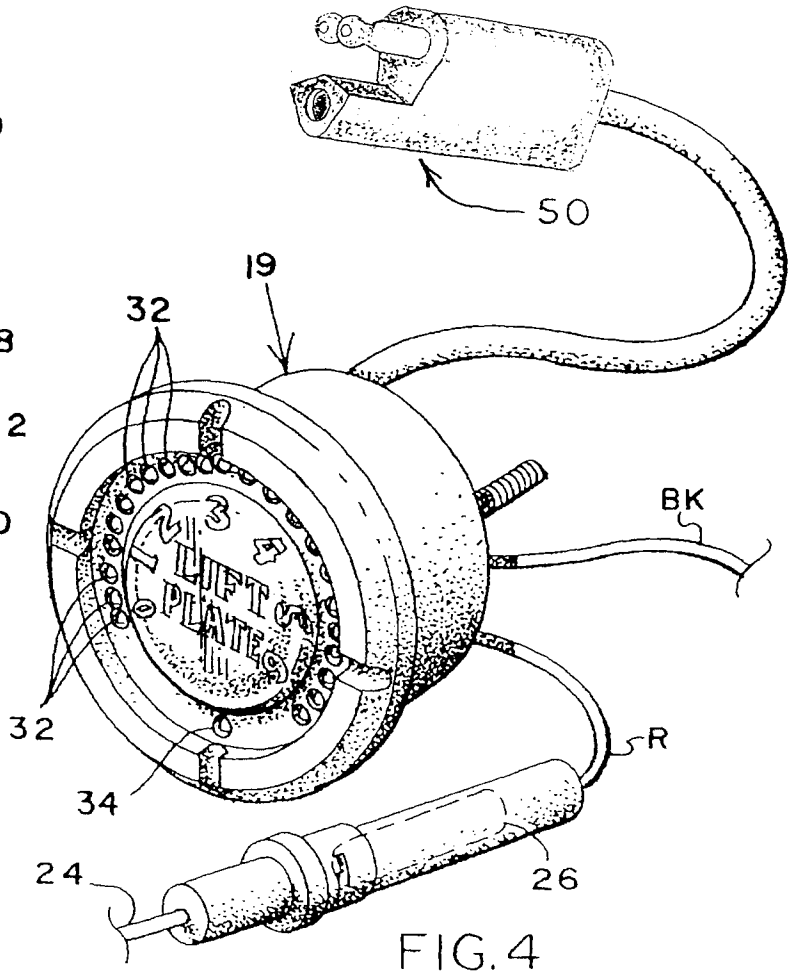
FIG. 4 is a perspective view showing the gauge assembly of this invention.

Referring to FIGS. 1 and 3 it can be seen that hydraulic jack plate 2 of this invention incorporates a plurality of components. These components generally comprise a pair of opposing supports 4 and 5 which are attached to the transom 7 of a boat 9 shown in partial section, supports 4 and 5 are interconnected by a plurality of lateral connectors 36, 38 40 and 42. The attachment of jack plate 2 to boat 9 is effected by bolts (not shown) which are passed through aperture 5, 8 and through the boat transom 7 in a conventional manner.

Figure 2:
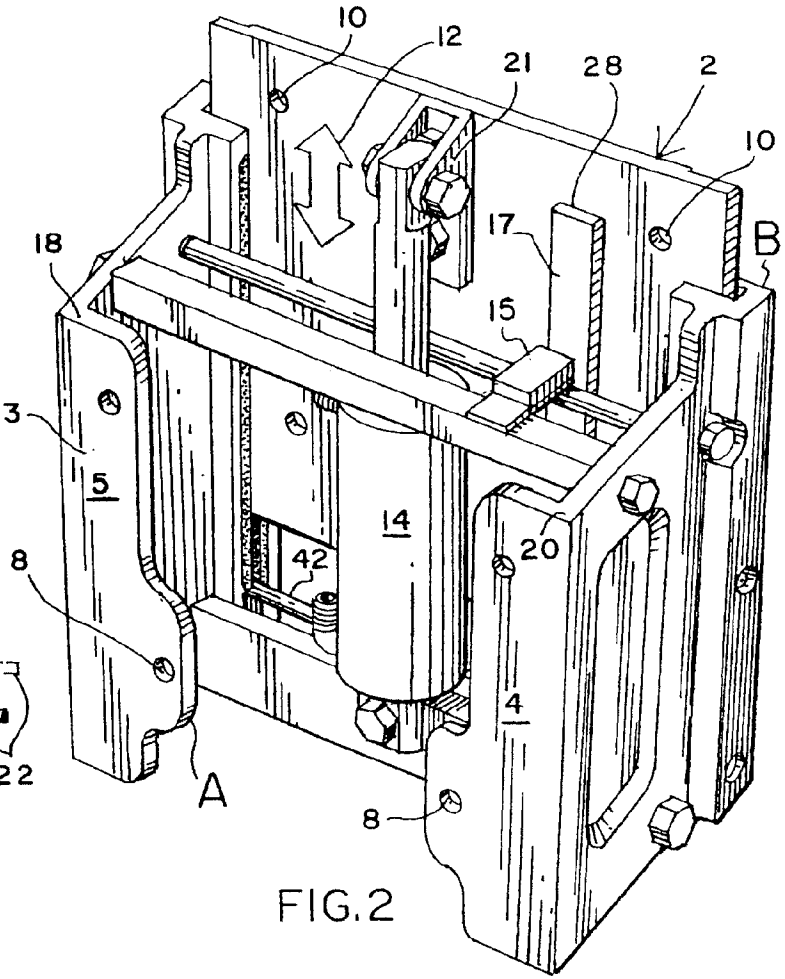
FIG. 2 is a perspective view showing a hydraulic jack plate with the position indicator of the invention attached thereto.

In the broadest embodiment the hydraulic jack plate 2 of this invention comprises a support 3 which in the illustrated structure of FIG. 2 comprises support members 4 and 5, a plurality of support bars and a slide 6 which can move up and down in a vertical plane. Support 3 has a first planar surface A which is adapted to being secured to the transom of a boat and a second planar surface B which is adapted to slideably engage slide 6.

When positioned in supports 4 and 5 in the manner described slide 6 can move up and down in a vertical plane in the directions of arrow 12. This invention is concerned with the position of slide 6 to a given reference point for example inner upper edges 18 and 20 of support 3. In order that the position of slide 6 might be determined support 3 is provided with a magnet 15 and a segmented transducer 17 which is attached to slide 6. Magnet 15 is used to activate the individual segments of transducer 17.

Slide 6 and support 3 are further interconnected by a hydraulic cylinder 14 which is attached to support 3, the piston thereof being attached to slide 6 via shaft 13 and bracket 21.

Hydraulic cylinder 14 is powered by hydraulic fluid which is provided for by a hydraulic pump, not shown. The hydraulic fluid being transferred from the hydraulic pump to hydraulic cylinder 14 via hydraulic lines (not shown) which interconnect the hydraulic pump and hydraulic cylinder 14, outboard motor 25 is attached to slide 6 via apertures 10. Hydraulic jack plates of the type described above and which are powered by a hydraulic cylinder and a hydraulic pump as described above are conventional in the prior art.

As can be further seen from FIG. 2 the full length of segmented transducer 17 passes by magnet 15 as slide 6 moves up and down in the directions of arrow 12. The movement of slide 6 is effected by hydraulic cylinder 14 in accordance with the description herein above.

In operation as slide 6 moves up and down different sections of segmented transducer 17 pass by magnet 15 via the Hall effect magnet 15 causes the individual segments of transducer 17 to produce a particular voltage as will be described herein below. When a given section of segmented transducer 17 passes by magnet 15 it is activated by magnet 15. The activation of this given section causes the section to produce a predetermined voltage output. The particular voltage output of any given section activates a particular L.E.D. in gauge 19 via a circuit which will be discussed below. Segmented transducer 17 has a top 28 and a bottom 30. The area between top 28 and bottom 30 is segmented into a plurality of sections. Each section produces a particular voltage which activates a particular L.E.D. in gauge 19. It is understood that the number of sections into which transducer 17 is divided is a matter of choice. The more sections transducer 17 is divided into the more accurate the position of slide 6 can be determined.

In conventional jack plates the total travel of slide 6 from its lowest to its highest position is about seven inches. With this amount of travel it has been found that the ability to determine the position of slide 6 over approximately a six inch span is adequate for normal hydraulic jack plate operation, that is the determination of the movement of slide 6 over a 0 to 6 inch range is adequate for normal hydraulic jack plate operation.

With this range of operation in mind it has been found to be desirable to divide transducer 17 into 25 sections which in turn correspond to each ¼ inch movement of slide 6.

Gauge 19 is in turn provided with 25 L.E.D.'s each of which can be activated by a L.E.D. driver integrated circuits. Therefore in operation as slide 6 moves up and down at any given position magnet 15 activates one section of transducer 17. This activated section of transducer 17 produces a specific voltage which in turn lights up a particular LED. That is as slide 6 moves up, for every ¼ inch the slide moves a different LED is activated. As can be seen gauge 19 incorporates twenty five L.E.D.'s in a circular pattern. A boat operator can readily determine the position of slide 6 by observing which L.E.D. in gauge 19 is lit up. By knowing the position of slide 6 the operator in turn knows how far outboard motor 25 is in the water as is the best indicated by the position of cavation plate 22 of outboard motor 25.

Figure 5:
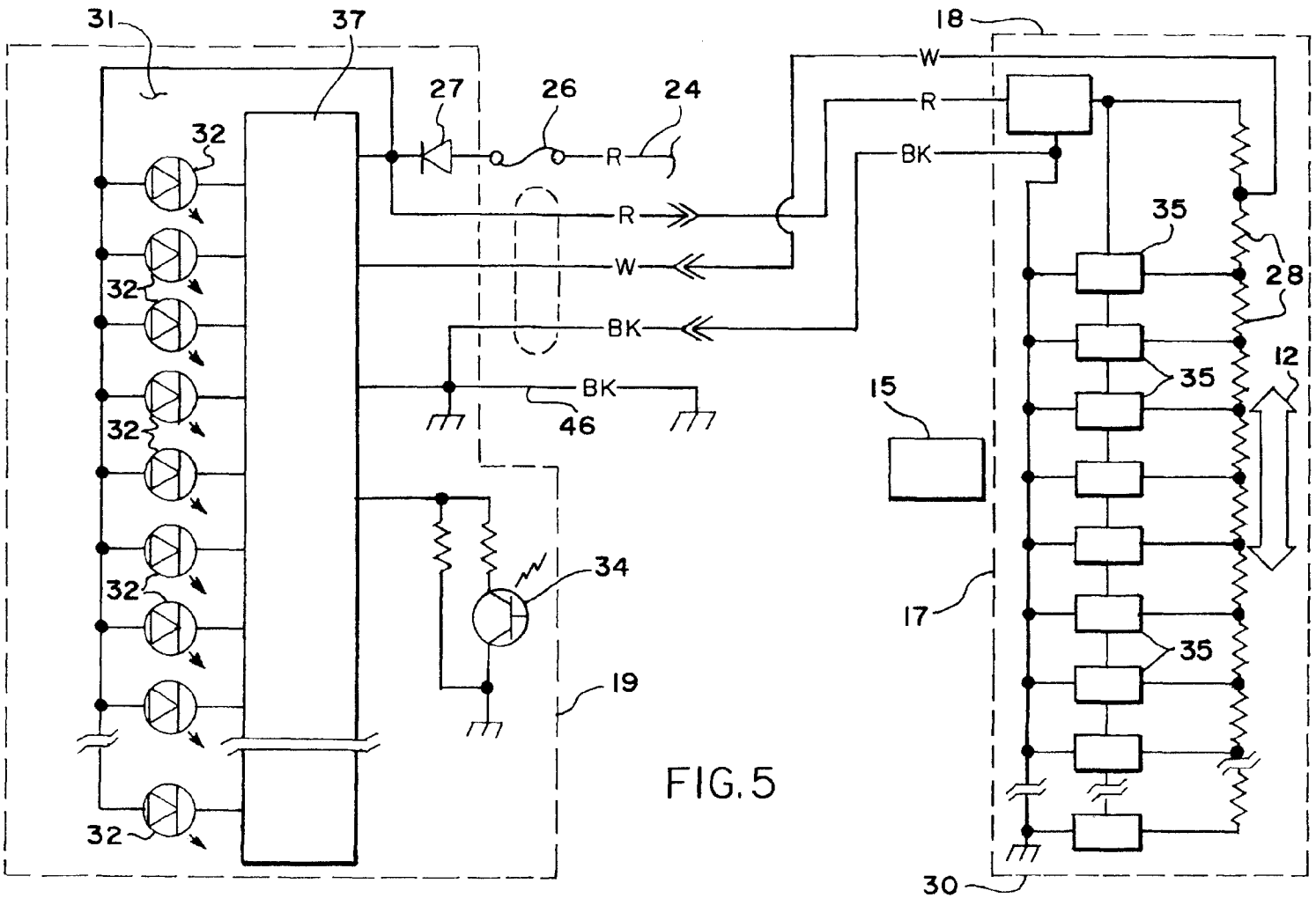
FIG. 5 is a circuit diagram of the position indicator of this invention.
Figure 6:
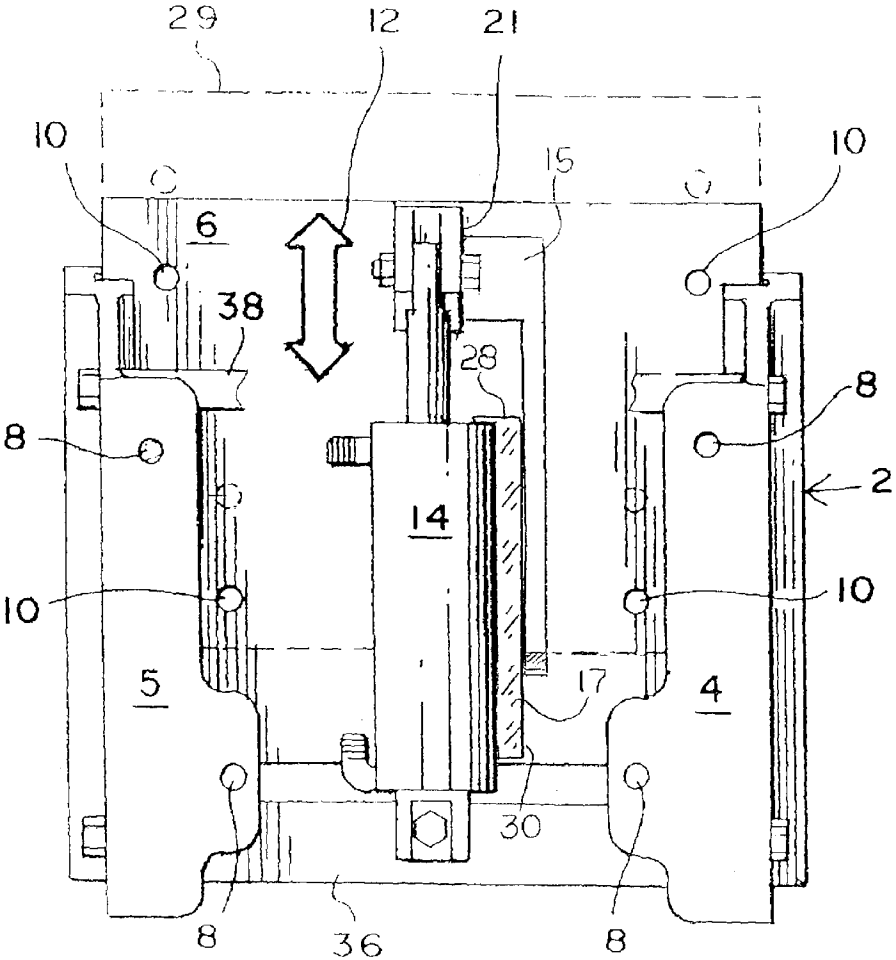
FIG. 6 is a rear view showing of a sensor assembly constructed in accordance with an alternate embodiment of the invention.

Referring to FIG. 5 it can be seen that the electrical circuit for use with the position indicator of this invention comprises a power source 24 which is connected via fuse 26 to a voltage resistance ladder divider 28. Intermediate of power 24 and ladder divider 28 is a protective diode 27 which protects the circuit from reverse bias current/voltage in the event the power is hooked up in reverse. Ladder divider 28 is further connected to an L.E.D. circuit 31 which incorporates a plurality of L.E.D.'s 32 which are positioned in gauge 19. In the preferred embodiment twenty five L.E.D's are used wherein the movement of slide in ¼ inch increments correspond to each L.E.D. 32.

The voltage produced by the individual segments of ladder divider 28 is picked up by a plurality of sensors 35 which sense small variations in the voltage output of ladder divider 28. Sensor 35 then transmit data relative to the voltage output of ladder divider 28 to L.E.D. driver integrated circuit 37.

Upon receipt of information from Sensors 35 L.E.D. integrated circuit 37 processes the data relative to the particular voltage output of a particular segment of ladder divider 28 and determines which of L.E.D.'s 32 should be activated. That is when a particular segment of ladder divider 28 produces a particular voltage this particular voltage is sensed by one of sensors 35. This voltage output information is then transmitted to L.E.D. driver integrated circuit 37 which processes the information and determines whether one of LED.'s 32 should be lit. Via this circuit the lighting up of a particular one of L.E.D. 32 correlates to a particular position of transducer 17 and hence a particular position of slide 6.

If desired a plurality of L.E.D. integrated circuits 37 may be used that is circuits 37 may be stacked. In the preferred embodiment three L.E.D. integrated circuits are stacked.

The voltage output of ladder divider 28 may vary over the range of 1 to 12 volts. In the preferred embodiment the range of voltage output of ladder divider 28 is 1 to 4.5 volts.

It is understood by one skilled in the art that any number of L.E.D.'s can be used to correspond to the movement of slide 6 through any desired range of travel.

Light sensor circuit 34 is further provided for whereby the voltage going to L.E.D.'s 32 can be varied in order to vary the intensity of the output of LED's 32 in order to make the light output L.E.D.'s 32 greatest in bright sunlight. Conversely when the ambient light decreases it is desirable to have the light output of L.E.D.'s 32 decrease.

Further one skilled in the art will recognize that the relationship of magnet 15 and transducer 17 could be reversed such that the transducer is stationary and the activator magnet moves.

Figure 7:
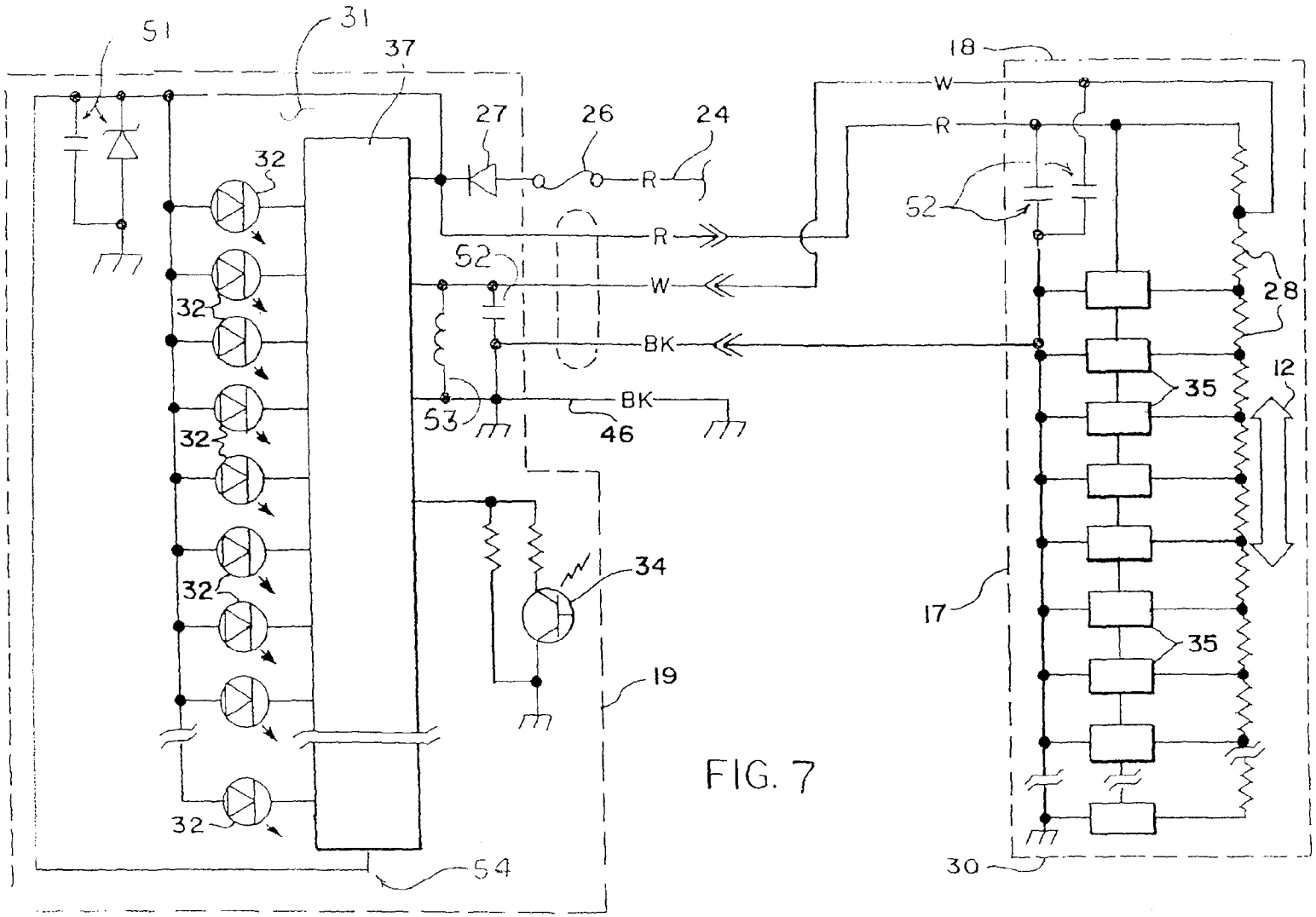
FIG. 7 is a circuit diagram of the position indicator of the alternate embodiment of the invention.

The present invention is an improvement over my above described prior patent and includes various major mechanical features which improves upon my invention of such prior patent. Such features include the repositioning of the slide 15 and the transducer 17. The transducer 17 is mounted to the hydraulic cylinder 14. The magnet/bracket 15 is mounted on the cylinder ram/slide bracket 21. As the slide is moved up or down illustrated by arrow 12, the magnet moves across the surface of the transducer 17 activating a particular section causing a predetermined voltage output. Note FIG. 7.

Conversely, the magnet assembly 15 is adapted to be mounted on the fixed cylinder 14 with the transducer 17 mounted on the cylinder ram/slide bracket 21.

The improved performance of the present invention arises in gauge applications where a hydraulic pump/hydraulic cylinder combination is used replacing the hydraulic cylinder only application. The limited space on the slide place 6 is blocked by the hydraulic pump/hydraulic cylinder combination leaving no open space available for the transducer and the magnet.

It should be readily understood that the improved positioning of the transducer and the magnet are readily adapted for new system constructions as well as for retrofitting existing systems.

The present invention is an improvement over my above described prior patent and includes various electrical features, each of which improves upon my invention of such prior patent. Such features include the water resistant connector 50. The connector is molded of a plastic material possessing a low static electric susceptibility.

Another electrical feature which improves upon my invention of such prior patent is an over-voltage protection circuit, such circuit is designed to protect the system in the event of it being connected to a voltage source greater than 12 volts, direct current. Such high voltage has recently become available on most new boat designs. Note FIG. 7.

Yet another electrical feature which improves upon my invention of such prior patent is an advanced two-way filtering circuit 52, 53 designed to both remove electronic noise present within the vessel's electrical system from interfering with the proper operation of the system. This filtering system also functions to prevent any electronic noise from this device from being injected onto the vessel's electrical system. Note FIG. 7.

The final electrical feature which improves upon my invention of such prior patent is a floating reference voltage 54 design to improve and enhance the reliable operation of the system as well as to allow the successful operation of the system over a broader voltage range. Note FIG. 7.

In should also be appreciated that the present invention possesses the ability for the transducer/magnet members to have the capability for being used separately with many off the shelf commercially available gages. The slide plate may readily be adapted for elevational movement by sliding vertically as shown as well as by angular or rotational raising and lowering.

These features in the present invention require a deletion of various unnecessary components from the invention of my prior patent including the 5 volt reference source, previously identified by reference numeral 15 of FIG. 5.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An improved hydraulic marine jack plate, comprising a support member and a slide member for use with an outboard engine, which will allow vertical movement of the outboard marine engine in a plane which is parallel with the transom of a boat when said jack plate is attached to said transom, said support being adapted to receive said slide member such that said slide member can move up and down in a plane which is approximately parallel with the transom, wherein said support member and said slide member are interconnected by a hydraulic cylinder which is in turn connected to a source of hydraulic power, wherein the improvement comprises; a position indicator, for tracking the position of the slide in relation to the support member, the position indicator comprising an electronic signal generator device including a transducer which is capable of being activated, and an electronic signal generating device including a magnet which is capable of activating the transducer, wherein one of the transducer and the magnet is attached to the hydraulic cylinder and wherein said electronic device is positioned near said activator and wherein the signal output of the electronic device is regulated, in relation to ambient light, by a photoelectric cell; and a water resistant connector molded of a plastic material possessing a static electric susceptibility; an over-voltage protection circuit designed to protect the system in the event of it being connected to a voltage source greater than a 12 volts, direct current; and an advanced two-way filtering circuit designed to both remove electronic noise present within the vessel's electrical system from interfering with the proper operation of the system, the filtering system also functioning to prevent any electronic noise from this device from being injected onto the vessel's electrical system.

* * * * *